US006594832B2

(12) United States Patent
Yang

(10) Patent No.: US 6,594,832 B2
(45) Date of Patent: Jul. 22, 2003

(54) SHOWER NOZZLE HANGER SYSTEM

(76) Inventor: Jung Young Yang, Changeupboyeuk Center 204, Jeju University, Ara 1-Dong, Jeju-Shi, Jeju-Do (KR)

( * ) Notice: Subject to any disclaimer, the term of this patent is extended or adjusted under 35 U.S.C. 154(b) by 0 days.

(21) Appl. No.: 10/003,443

(22) Filed: Dec. 6, 2001

(65) Prior Publication Data

US 2003/0041372 A1 Mar. 6, 2003

(51) Int. Cl.[7] ..... A47K 3/28

(52) U.S. Cl. ..... 4/605; 4/570; 239/283; 239/583

(58) Field of Search ..... 4/605, 615, 567, 4/570; 248/206.5; 239/283, 583

(56) References Cited

U.S. PATENT DOCUMENTS 1,287,272 A * 12/1918 Fisher ..... 239/583
5,360,172 A * 11/1994 Wang ..... 239/586
5,865,375 A * 2/1999 Hsu ..... 4/615 X
6,135,408 A * 10/2000 Richter ..... 248/309.4

FOREIGN PATENT DOCUMENTS

DE 2109642 * 1/1971 ..... 4/615
EP 0515322 * 11/1992 ..... 4/605

* cited by examiner

*Primary Examiner*—Charles E. Phillips
(74) *Attorney, Agent, or Firm*—Birch, Stewart, Kolasch & Birch, LLP

(57) ABSTRACT

A shower nozzle hanger system including a shower nozzle unit having a shower nozzle containing a thin metal plate disposed therein and a shower nozzle hanger unit having a permanent magnet plate secured thereon and a pair of lateral flanges for the shower nozzle unit whereby after using the shower nozzle unit, the shower nozzle unit can be easily and effectively engaged and disengaged wit the shower nozzle hanger unit.

3 Claims, 2 Drawing Sheets

SHOWER NOZZLE HANGER SYSTEM

BACKGROUND OF THE INVENTION

1. Field of the Invention

The present invention relates to an improved shower nozzle hanger system and more particularly, to a shower nozzle hanger system which includes a shower nozzle unit having a metal plate disposed within the back side thereof and a shower nozzle hanger unit having a permanent magnet plate attached thereto for ready engagement and disengagement of the shower nozzle with the nozzle hanger system.

2. Description of Related Art

Various types of shower nozzle hanger systems are known in the art. Generally, a shower nozzle hanger unit includes a ring type hanger having an opening disposed at the front side thereof.

As shown in FIG. 1, a conventional shower nozzle hanger system includes a shower nozzle 10 having a shower body 14, a nozzle 12, a hanging part 16, a water hose 17, and a hanger 18 having a mounting ring 19 mounted to the hanger 18. The hanger 18 is usually attached to the wall of the shower room or bathroom.

However, such a conventional shower nozzle hanger system suffers from many problems. For example, when the user uses the conventional shower nozzle hanger, the user must lift the shower nozzle 10 over the one opening ring type hanger 19 and when the user does not use the shower nozzle 10, in turn, the user must insert the water hose 17 into the one opening ring type hanger 19 and put the hanging part 16 on the hanger 19. In this regard, it is difficult to match the hanging part 16 with the hanger 19 in a steam filled shower room, and thus it frequently happens that the shower nozzle 10 falls down which can cause injury to the user's body. Also, the shower nozzle can be readily broken.

SUMMARY OF THE INVENTION

Accordingly, it is an object of the present invention to provide an improved shower nozzle hanger system which eliminates the above problems encountered with conventional shower nozzle hanger systems.

Another object of the present invention is to provide a shower nozzle hanger system for easily and effectively mounting and dismounting a shower nozzle unit with a shower nozzle hanger unit.

A further object of the present invention is to provide a shower nozzle hanger system which includes a shower nozzle unit having a thin metal plate disposed within a back side thereof and a shower nozzle hanger unit having a permanent magnet attached thereto for providing a reliable shower nozzle mounting system.

Still another object of the present invention is to provide a shower nozzle hanger system which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a shower nozzle hanger system which includes a shower nozzle unit having a shower nozzle containing a thin metal plate disposed therein and a shower nozzle hanger unit having a permanent magnet plate secured therein and a pair of lateral flanges for the shower nozzle unit whereby after using the shower nozzle unit, the shower nozzle unit can be easily and effectively mounted on the shower nozzle hanger unit and protected from falling by the lateral flanges.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
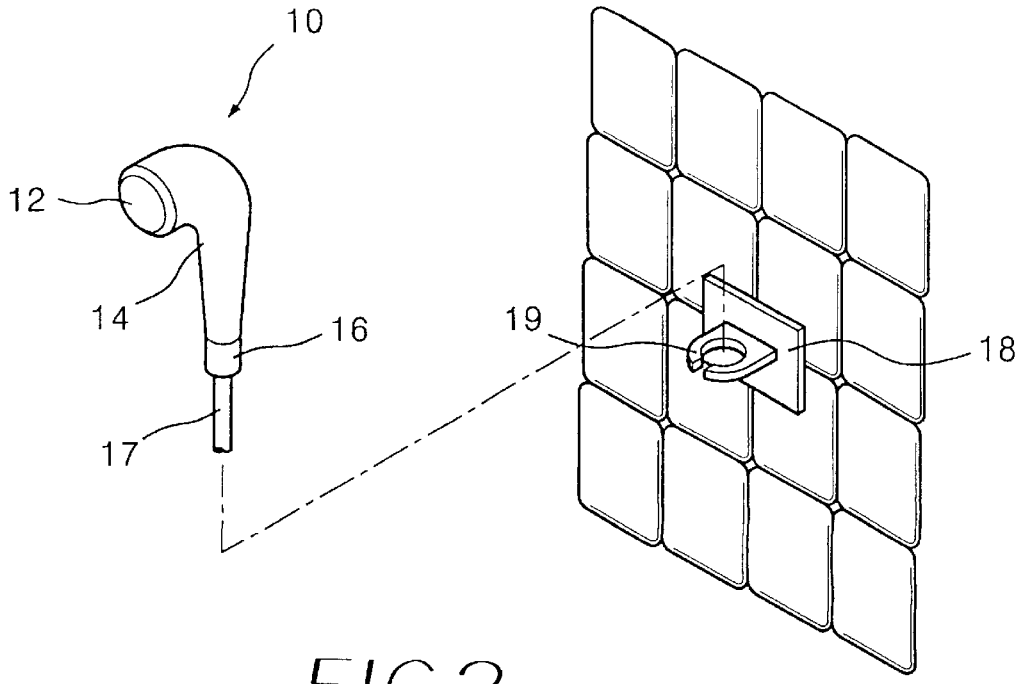
FIG. 1 CONVENTIONAL ART
FIG. 1 is a perspective view of a conventional shower nozzle hanger system in a separated position.
Figure 2:
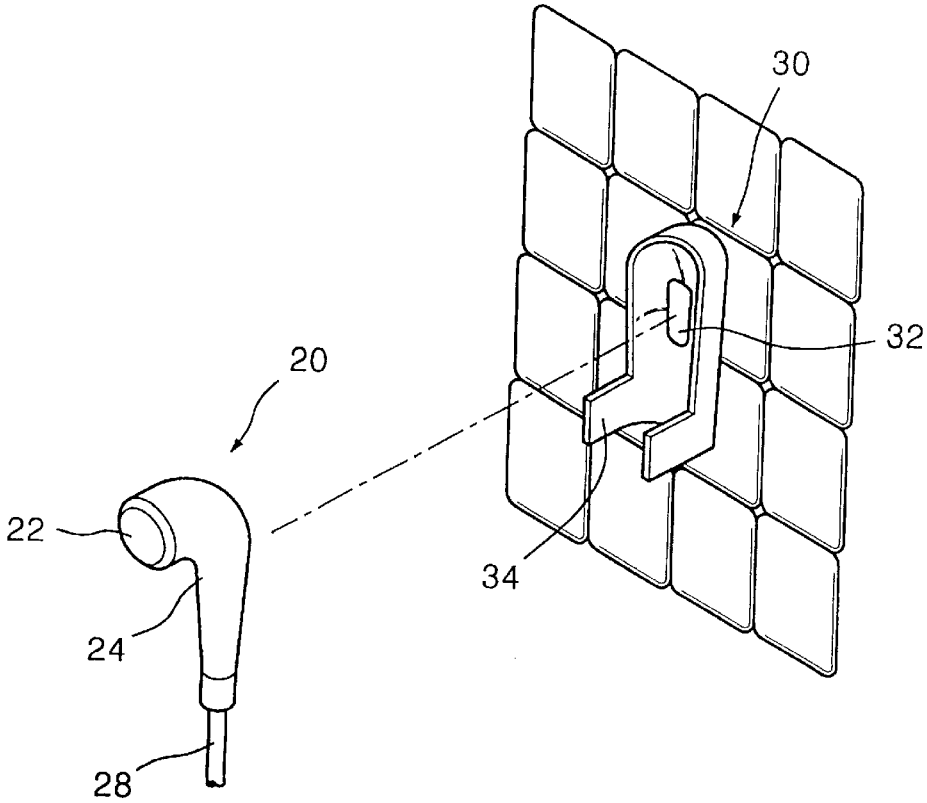
FIG. 2 is a perspective view of a shower nozzle hanger system according to the present invention in a separated position.
Figure 3:
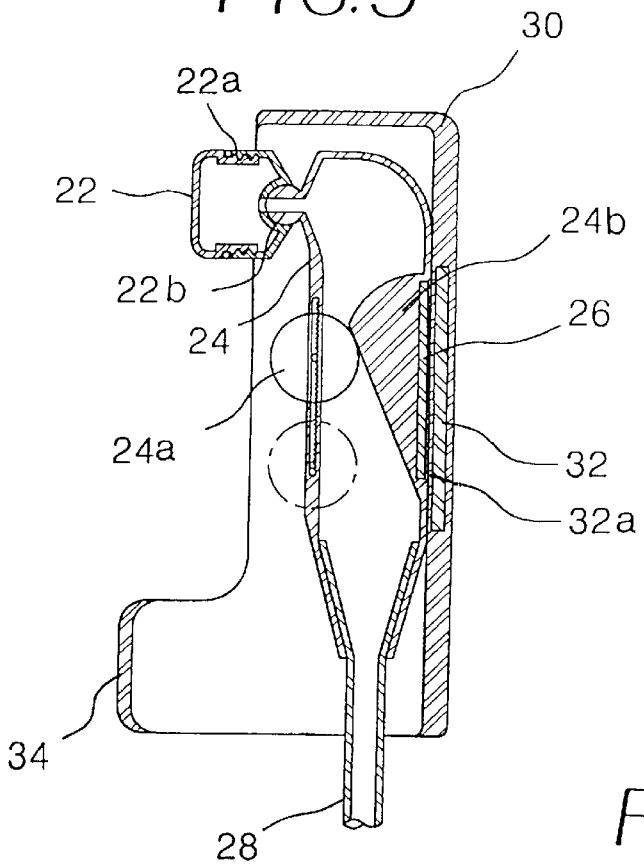
FIG. 3 is a sectional view of the shower nozzle hanger system according to the present invention in a hanging or mounted position.
Figure 4:
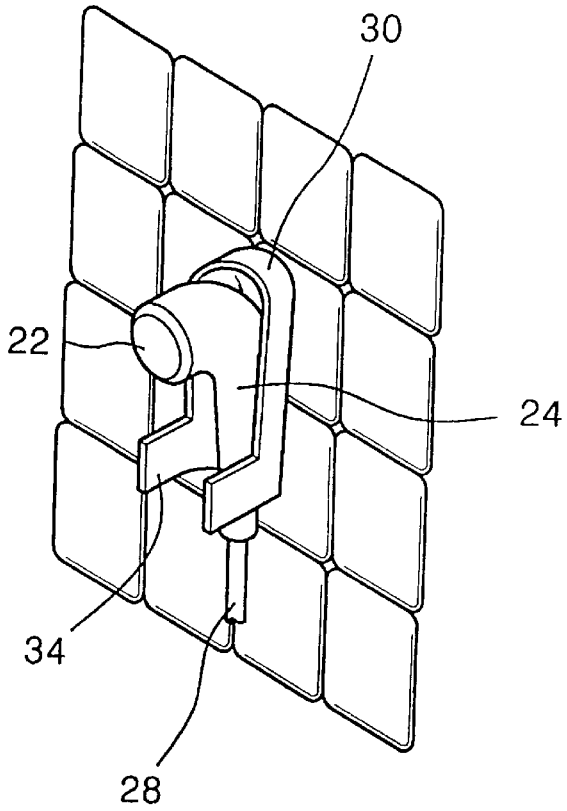
FIG. 4 is a perspective view of the shower nozzle hanger system according to the present invention in a hanging or mounted position.

Referring now in detail to the drawings for the purpose of illustrating preferred embodiments of the present invention, the shower nozzle hanger system as shown in FIGS. 2, 3 and 4, comprises a shower nozzle unit 20 containing a thin metal plate therein and a shower nozzle hanger unit 30 containing a permanent magnetic plate 32 disposed therein for easily and effectively receiving the shower nozzle with the assistances of the magnetic force between the thin metal plate and the magnetic plate.

As shown in FIG. 3, the shower nozzle unit 20 includes a shower body 24, a nozzle 22 disposed on the shower body 24, and a water hose 28 connected to the nozzle unit 20 from the water source (not shown). A shower direction adjusting ball **22*b* disposed between the nozzle 22 and the shower body 24 for easily adjusting the shower direction after the shower nozzle unit 20 is mounted on the shower nozzle hanger 30. A water pressure controller 24*a* is provided at the front side of the shower body 24 for controlling the water pressure by moving up and down, whereby the water pressure controller 24*a* adjusts the space between itself and a raised portion 24*b* extending from the inside the wall of the shower body 24 (FIG. 3**).

Referring to FIG. 3, the shower nozzle hanger unit 30 includes the permanent magnet plate 32 disposed therein so as to face in opposition to the thin metal plate 26 of the shower body 24 when the shower nozzle unit 20 is mounted on the shower nozzle hanger unit 30. A pair of flanges 34 extend from the lower portion of the nozzle hanger unit 30 for preventing the shower nozzle unit 20 from being laterally displaced from the shower nozzle hanger unit 30. A coating layer **32*a* covers the surface of the permanent magnet 32 for absorbing the impact of the shower nozzle unit 20**.

Referring to FIGS. 2 and 4, the shower nozzle hanger system according to the present invention operates as fol lows. As shown in FIG. 2, when the user is using the shower nozzle unit 20, the shower nozzle unit 20 is separated from the shower nozzle hanger unit 30. After the user uses the shower nozzle unit 20, the user puts the shower nozzle unit 20 on the shower nozzle hanger unit 30. At this time, due to magnetic force, the back surface of the shower nozzle unit 20 automatically attaches to the inside wall of the shower nozzle hanger unit 30.

In turn, when the user decides to use the shower nozzle unit 20, the user readily disengages the shower unit 20 from the shower nozzle hanger unit 30. When the shower nozzle unit 20 accidentally falls, the nozzle 22 of the shower nozzle unit 20 engages the pair of flanges 34 which prevents the shower nozzle unit 20 from completely falling. The space between the pair of flanges 34 is sufficiently narrow to engage the shower unit while at the same time permitting ready access of the water hose 28 of the shower nozzle unit 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shower nozzle hanger system comprising:

a shower nozzle unit including a metal plate operatively associated with the back side thereof, and a shower nozzle hanger unit containing a permanent magnet provided at the front wall thereof for easily and effectively mounting and dismounting the shower nozzle unit with the shower nozzle hanger unit, wherein lateral flanges extend from the lower portion of the shower nozzle hanger unit.

2. The shower nozzle hanger system of claim 1, wherein said shower nozzle hanger unit further contains a coating layer disposed on the surface of the permanent magnet for absorbing the impact of the shower nozzle hanger unit.

3. The shower nozzle hanger system of claim 1, wherein said shower nozzle unit comprises a nozzle, a shower body, a water hose, a shower direction adjusting ball disposed between the nozzle and the shower body, and a water pressure controller disposed at the front side thereof for adjusting the water pressure by moving up and down and adjusting the space between the water pressure controller and a portion extending from an inside wall of said shower body.

* * * * *